US010756405B2

(12) United States Patent
Borrelli et al.

(10) Patent No.: US 10,756,405 B2
(45) Date of Patent: Aug. 25, 2020

(54) WAVEGUIDE SYSTEM COMPRISING A HOLLOW GLASS WAVEGUIDE ATTACHED TO GLASS CONNECTORS AND THE GLASS WAVEGUIDE INCLUDING AN EMBEDDED METAL LAYER

(71) Applicant: CORNING INCORPORATED, Corning, NY (US)

(72) Inventors: Nicholas Francis Borrelli, Elmira, NY (US); David John McEnroe, Corning, NY (US); Joseph Francis Schroeder, III, Lindley, NY (US); Dean Michael Thelen, Addison, NY (US); William Richard Trutna, Atherton, CA (US)

(73) Assignee: Corning Incorporated, Corning, NY (US)

( * ) Notice: Subject to any disclaimer, the term of this patent is extended or adjusted under 35 U.S.C. 154(b) by 92 days.

(21) Appl. No.: 16/151,918

(22) Filed: Oct. 4, 2018

(65) Prior Publication Data

US 2019/0109360 A1 Apr. 11, 2019

Related U.S. Application Data

(60) Provisional application No. 62/568,536, filed on Oct. 5, 2017.

(51) Int. Cl.

| | |
|---|---|
| ***H01P 3/12*** | (2006.01) |
| ***H01P 11/00*** | (2006.01) |
| ***H01P 1/04*** | (2006.01) |

(52) U.S. Cl.

CPC ..... *H01P 3/122* (2013.01); *H01P 1/042* (2013.01); *H01P 3/12* (2013.01); *H01P 11/002* (2013.01)

(58) Field of Classification Search

CPC .... H01P 3/12; H01P 3/122; H01P 3/16; H01P 3/20; H01P 11/001; H01P 11/002; H01P 11/006; H01P 1/042; G02B 6/00

USPC ..... 333/239, 248

See application file for complete search history.

(56) References Cited

U.S. PATENT DOCUMENTS

| | | | | |
|---|---|---|---|---|
| 3,549,233 | A * | 12/1970 | Eaglesfield et al. | H01P 3/16 385/127 |
| 4,441,091 | A * | 4/1984 | Nishida et al. | H01Q 13/20 333/242 |
| 5,363,464 | A * | 11/1994 | Way et al. | H01P 3/12 333/212 |
| 9,487,441 | B2 | 11/2016 | Borrelli et al. | |
| 9,586,861 | B2 | 3/2017 | Borrelli et al. | |

(Continued)

*Primary Examiner* — Benny T Lee

(74) *Attorney, Agent, or Firm* — Russell S. Magaziner

(57) ABSTRACT

A hollow glass waveguide and related method are provided. The microwave waveguide includes a glass body including a first end, a second end, an outer glass surface extending between the first end and the second end, an inner glass surface defining a hollow channel that extends from the first end to the second end and a glass material between the outer surface and the inner surface. The microwave waveguide includes a layer of metal embedded in the glass body. The layer of metal surrounds the hollow channel when viewed in cross-section and extends between the first end and the second end of the glass body. The layer of metal is electrically conductive and the hollow channel is dimensioned such that microwaves introduced into the hollow channel are conducted along the hollow channel between the first end and the second end.

20 Claims, 5 Drawing Sheets

(56) References Cited

U.S. PATENT DOCUMENTS

| | | | | |
|---|---|---|---|---|
| 9,917,349 | B2 * | 3/2018 | McMilin et al. | H01Q 1/243 |
| 10,116,035 | B2 | 10/2018 | Borrelli et al. | |

* cited by examiner

WAVEGUIDE SYSTEM COMPRISING A HOLLOW GLASS WAVEGUIDE ATTACHED TO GLASS CONNECTORS AND THE GLASS WAVEGUIDE INCLUDING AN EMBEDDED METAL LAYER

CROSS-REFERENCE TO RELATED APPLICATIONS

This application claims the benefit of priority of U.S. Provisional Application Ser. No. 62/568,536 filed on Oct. 5, 2017 the contents of which are relied upon and incorporated herein by reference in their entirety as if fully set forth below.

BACKGROUND

The disclosure relates generally to the field of waveguides, and specifically to hollow waveguides used to conduct electromagnetic radiation, such as microwave radiation. Some microwave waveguides are solid dielectric waveguides that utilize a different dielectric constant between the waveguide core and cladding layers to conduct microwave radiation along the length of the waveguide. Typically, such solid dielectric waveguides utilize polymer based constructions, rather than glass. Some other microwave waveguides are hollow waveguides formed from a piece of metal material shaped to have a hollow channel of the appropriate dimensions to provide microwave waveguide functionality.

SUMMARY OF THE INVENTION

One embodiment of the disclosure relates to a microwave waveguide including a glass body. The glass body includes a first end, a second end, an outer glass surface extending between the first end and the second end and an inner glass surface defining a hollow channel that extends from the first end to the second end. The glass body include a glass material between the outer surface and the inner surface. The microwave waveguide includes a layer of metal embedded in the glass body, and the layer of metal surrounds the hollow channel when viewed in cross-section and extends between the first end and the second end of the glass body. The layer of metal is electrically conductive and the hollow channel is dimensioned such that microwaves introduced into the hollow channel are conducted along the hollow channel between the first end and the second end.

An additional embodiment of the disclosure relates to a waveguide system including a glass waveguide and a glass connector. The glass waveguide includes a first end, a second end, an outer peripheral surface and an inner surface defining a hollow channel that extends from the first end to the second end. The glass waveguide includes first glass material located between the outer peripheral surface and the inner surface, and a layer of metal embedded in the first glass material. The layer of metal surrounds the hollow channel when viewed in cross-section. The glass connector is coupled to the first end of the glass waveguide. The connector includes a second glass material, an outer peripheral surface and an inner surface defining a central bore. The first end of the glass waveguide is received into the central bore such that the glass connector surrounds the first end of the glass waveguide.

An additional embodiment of the disclosure relates to a method of forming a waveguide. The method includes forming an ion-exchangeable glass preform into a tube having an inner surface defining a channel extending between opposing ends of the tube. The method includes exchanging sodium ions in the ion-exchangeable glass of the tube for silver ions through the inner surface. The method includes forming the silver ions in the ion-exchangeable glass of the tube into at least one layer of metallic silver located within the ion-exchangeable glass of the tube and embedded a distance below the inner surface of the tube.

Additional features and advantages will be set forth in the detailed description that follows, and, in part, will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The accompanying drawings are included to provide a further understanding and are incorporated in and constitute a part of this specification. The drawings illustrate one or more embodiment(s), and together with the description serve to explain principles and the operation of the various embodiments.

DETAILED DESCRIPTION OF THE INVENTION

Figure 1:
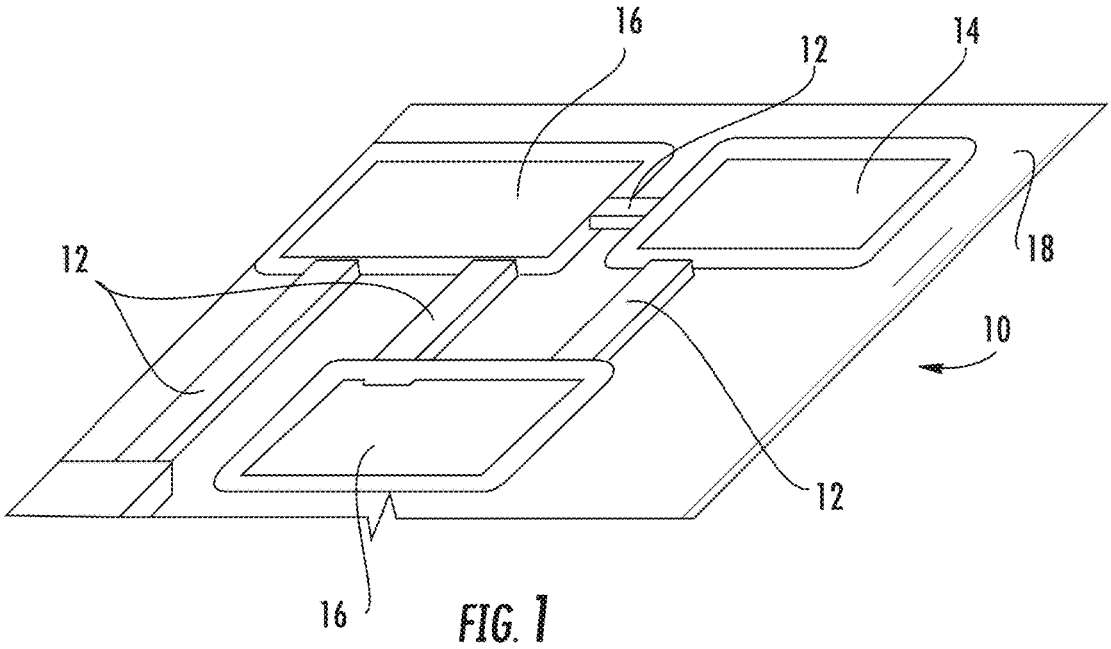
FIG. 1 is a schematic view of an electronic system utilizing a hollow glass waveguide, according to an exemplary embodiment.

Referring generally to the figures, various embodiments of a hollow, glass waveguide are provided. In specific embodiments, the waveguides discussed herein are designed to conduct microwaves, and specifically microwaves having frequencies from 20 GHz-50 GHz.

In general, the waveguides discussed herein have a single, unitary and/or monolithic glass body that defines a hollow central channel. A layer of electrically conductive metal is embedded within the glass body forming a metal layer that surrounds the central channel when viewed in cross-section.

The hollow channel is dimensioned to provide waveguide functionality for the desired frequencies of electromagnetic radiation, and the electrically conductive nature of the embedded metal layer allows the hollow glass structure to act as a waveguide conducting electromagnetic radiation (e.g., microwaves) along the hollow channel between ends of the waveguide. Such waveguides can be used in a variety of electronics/communications systems in which communication of signals in the microwave frequency ranges is desired.

In specific embodiments discussed herein, the layer of metal embedded within the glass is formed via an ion exchange process in which a metal ion (e.g., silver, copper, etc.) is exchanged into the glass structure. Then, the exchanged metal ions within the glass waveguide body are reduced, for example via exposure to a flow of hydrogen gas, forming embedded metal layers within the glass structure. Surprisingly, the Inventor has determined that this process for forming a glass-embedded metal layer achieves a low enough level of resistivity for the hollow glass structure with embedded metal layer discussed herein to function as a waveguide with satisfactorily low levels of signal loss.

The Inventor has further found that the waveguide designs discussed herein, while the waveguide designs do provide sufficient levels of signal loss for some/many waveguide applications, the waveguide designs do not provide the same extremely low levels of loss provided by all metal hollow waveguides. However, the Inventor determined that the waveguide structure discussed herein provides other desirable benefits despite having levels of signal loss greater than all metal hollow waveguides. For example, because the metal layer of the present waveguide design is embedded within the glass material, the metal layer is protected by the glass from damage and/or degradation that exposure to the environment may cause. In addition, in at least some embodiments, due to the nature of glass forming techniques and the ion-exchange metal embedding process, the waveguides discussed herein can be thin, lightweight and utilize relatively little metal material, as compared to typically hollow all metal waveguides. In addition, glass forming techniques allow for the hollow glass waveguides to be shaped into essentially any shape, including curves and 90 degree bends, that are difficult to form in an integral piece of hollow metal, while also maintaining precise geometry of the hollow channel that are needed to ensure the desired waveguide performance.

As compared to solid dielectric waveguides, the hollow glass waveguides discussed herein are believed to provide better signal transmission (i.e., have less signal loss). Thus, the hollow glass waveguides discussed herein are believed to provide the material, manufacturing, cost and shaping benefits of a glass material and while at the same time providing lower levels of signal transmission loss resulting from the electrical conductivity provided by the embedded metal layer. As such, the Inventor believes that the hollow glass waveguides discussed herein capture a unique set of performance parameters and manufacturability parameters, not previously achieved by either conventional solid dielectric waveguides or hollow, all metal waveguides.

Referring to FIG. 1, an electronic system 10 is shown according to an exemplary embodiment. In general, electronic system 10 includes a plurality of different electronic devices that are communicably coupled by hollow, glass waveguides 12. Electronic system 10 generally represents any electronic system that may utilize waveguides 12 to communicably connect different parts of the system, different devices within the system, different systems or subsystems within a communications network, etc.

In a specific embodiment as shown in FIG. 1, waveguides 12 connect memory 14 and a variety of processing circuits or processors 16 that are supported on an electronics board 18. In specific embodiments, electronics system 10 is a system that utilizes microwave frequency (e.g., microwave frequency of 20 GHz to 50 GHz) to communicate within the system, and in such embodiments, hollow glass waveguides 12 are configured to provide waveguide functionality in the desired microwave frequency range.

Figure 2:
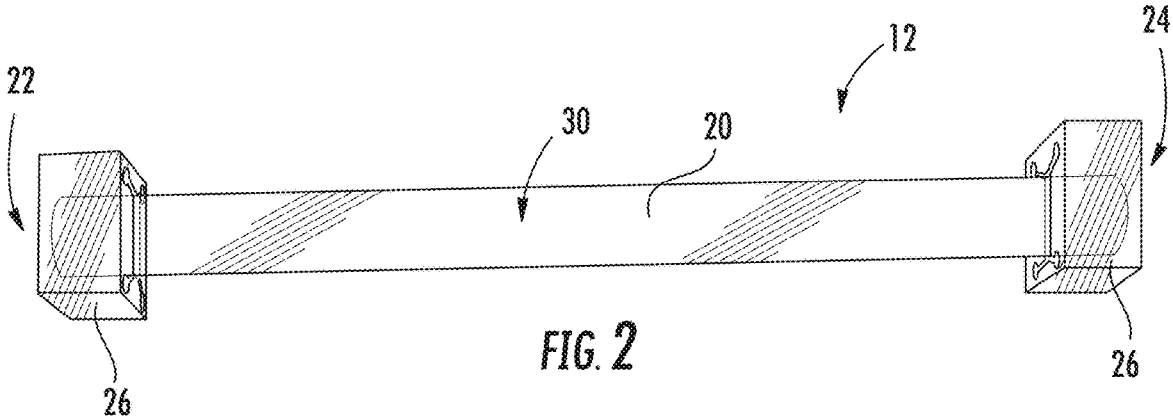
FIG. 2 is a top plan view of a hollow glass waveguide with connectors, according to another exemplary embodiment.
Figure 3:
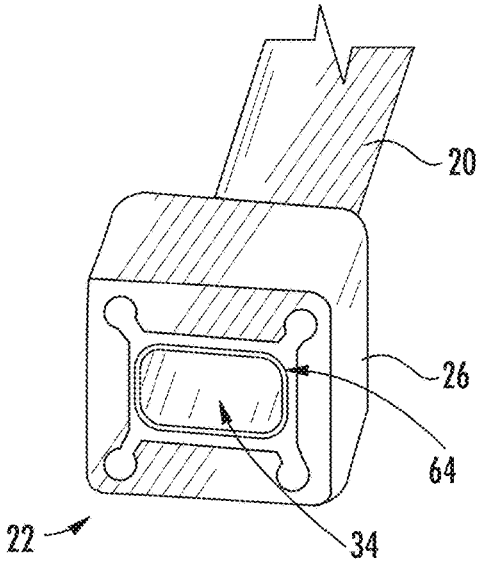
FIG. 3 is a perspective end view of a hollow glass waveguide and connector of FIG. 2, according to another exemplary embodiment.
Figure 4:
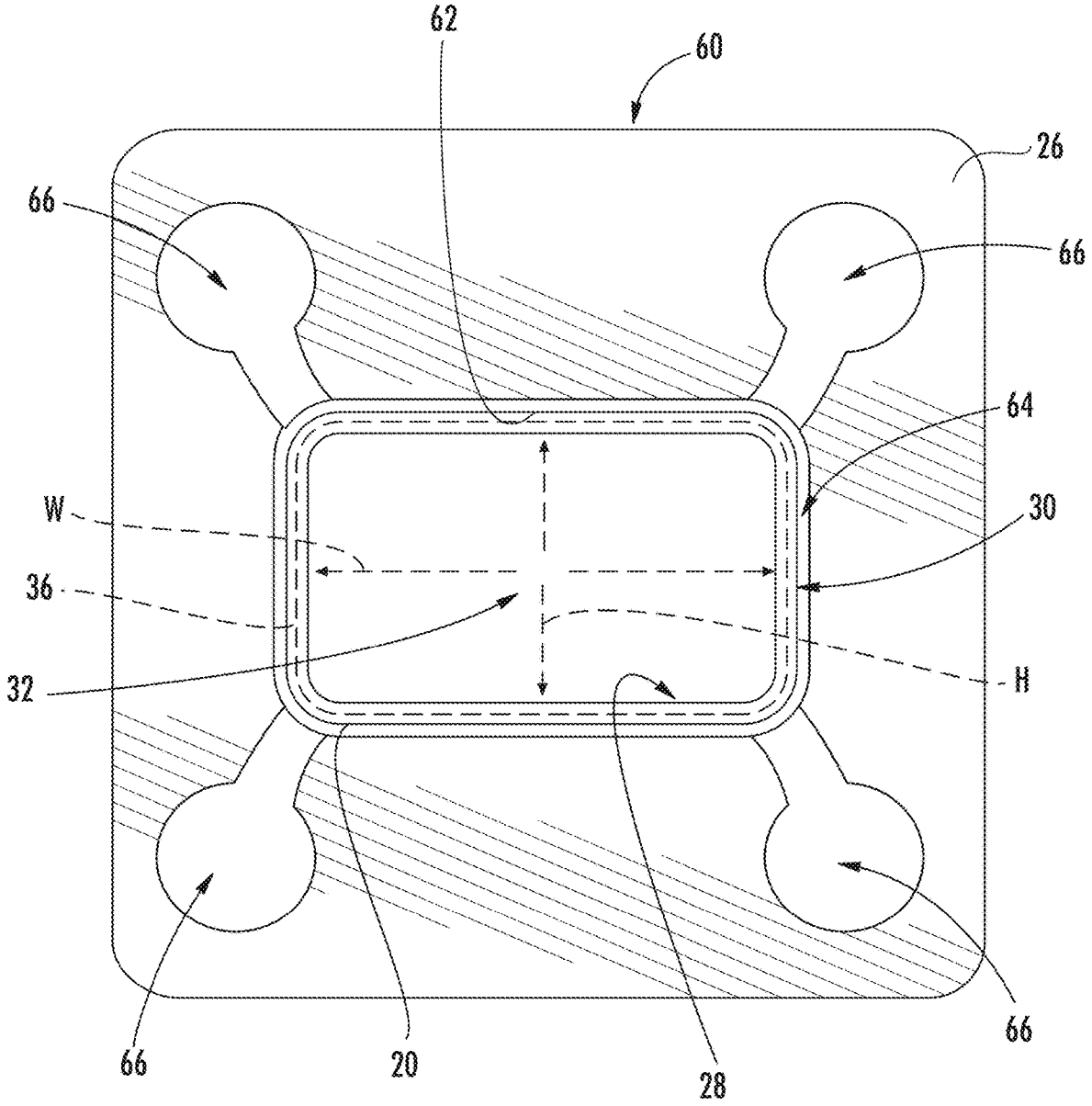
FIG. 4 is a detailed cross-sectional view of the hollow glass waveguide and connector of FIG. 2, according to an exemplary embodiment.

Referring to FIGS. 2-4, the structure of hollow glass waveguide 12 is shown in more detail in FIG. 2. Hollow glass waveguide 12 includes a glass body 20 as shown in FIGS. 2 and 3. In general, glass body 20 is an elongated tube that extends from a first end 22 to a second end 24. As will be discussed in more detail below, in order to facilitate coupling of waveguide 12 to the desired components within electronic system 10 (e.g., various electronic devices, other adjacent waveguides, etc.), a glass connector 26 as shown in FIGS. 2 and 3 may be coupled to first end 22 as shown in FIGS. 2 and 3) and/or to second end 24 (shown in FIG. 2) of waveguide 12.

Glass body 20 of waveguide 12 has an inner surface 28 and an outer surface 30 (as shown in FIGS. 2 and 4). As shown best in FIG. 4, inner surface 28 defines a hollow channel 32 located within glass body 20. Hollow channel 32 extends the entire length of waveguide 12 between first end 22 and second end 24 such that openings 34 (only one of which is shown in FIG. 3) are defined in each end of waveguide 12.

As shown schematically in FIG. 4, waveguide 12 includes one or more layers of metal 36 embedded within glass body 20. Metal layer 36 surrounds hollow channel 32 when viewed in cross-section and also extends the entire length of glass body 20 between the ends 22 and 24. In general, metal layer 36 is electrically conductive enough and hollow channel 32 is appropriately dimensioned such that electromagnetic waves, and microwaves in particular, that are introduced into hollow channel 32 at one end of the waveguide are conducted along hollow channel 32 to the opposite end of the waveguide. In this manner, waveguide 12 is able to conduct the desired frequencies of electromagnetic radiation between ends of the waveguide.

Glass body 20 is formed from a glass material, and in specific embodiments, glass body 20 is formed from a single, integral, unitary glass body in which one or more metal layers are embedded. In such embodiments, both inner surface 28 and outer surface 30 are glass surfaces that extend the entire distance between ends 22 and 24. In such embodiments, the glass material of glass body 20 is continuous with both inner surface 28 and outer surface 30, and metal layer 36 is embedded within the unitary glass body. In particular embodiments, the glass material of glass body 20 extends between inner surface 28 and outer surface 30.

As shown best in FIG. 4, metal layer 36 is embedded within glass body 20 such that inner surface 28 is located between metal layer 36 and hollow channel 32. In such embodiments, inner surface 28 and the portion of glass material that is located inside of metal layer 36 completely covers metal layer 36 such that metal layer 36 is not exposed to or in contact with air that may be located within hollow channel 32. In such embodiments, in contrast to all metal hollow waveguides, metal layer 36 is protected from the environment by the glass material of glass body 20.

Figure 5:
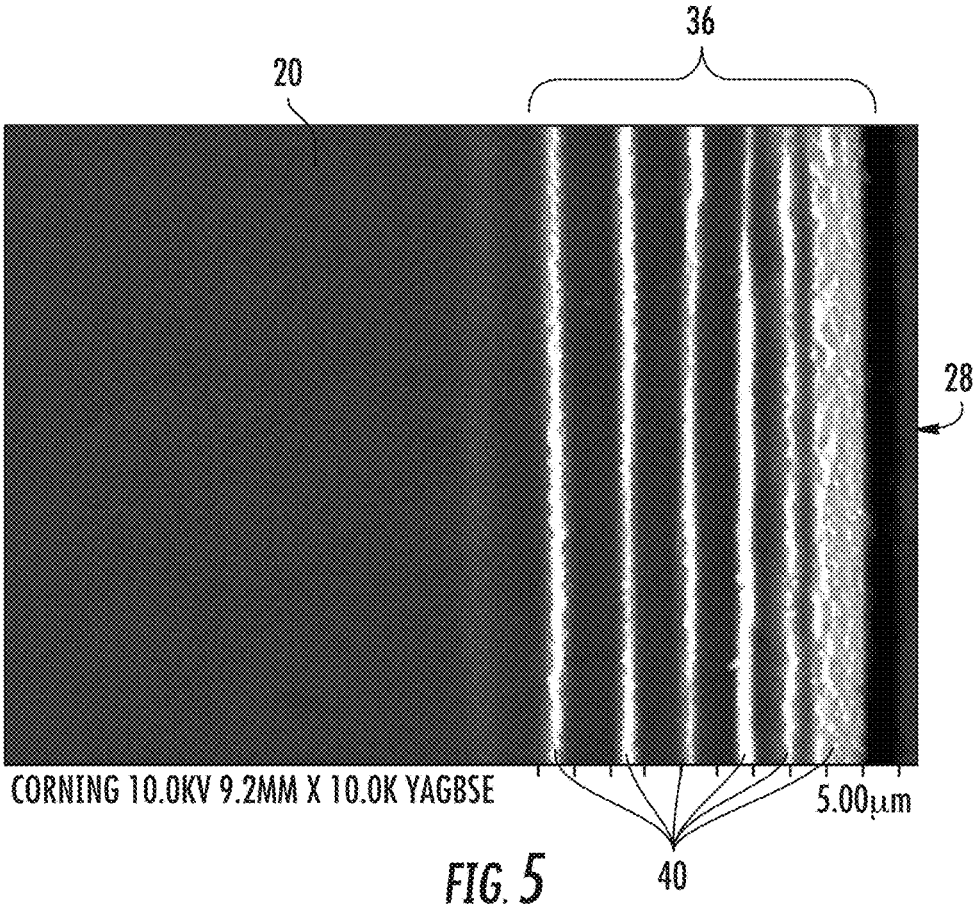
FIG. 5 is a cross-sectional SEM image of an embedded metallic layer of a hollow glass waveguide, according to an exemplary embodiment, where 5 μm refers to scale and the descriptive wording therein refers to the particular sample.

As will be explained in more detail below, in specific embodiments, metal layer 36 is formed within unitary glass body 20 via a process of ion exchange and ion reduction that results in a metal layer being embedded within glass body 20 and separated a distance from inner surface 28 also shown in FIG. 5. In specific embodiments, metal layer 36 is embedded adjacent to the inner surface 28 a distance of less than or equal to 5 μm. In a specific embodiment, as shown in the SEM image of FIG. 5, metal layer 36 includes a plurality of discreet metal layers 40 located at different depths within glass body 20. In specific embodiments, discreet metal layers 40 are metallic silver layers that are formed via the ion-exchange and reduction process discussed below. In other embodiments, discreet metal layers 40 may be formed from metallic copper, that may also be formed via a similar ion-exchange and reduction process.

In embodiments in which metal layer 36 is formed via an ion-exchange and reduction process as discussed herein, glass body 20 is formed from an ion-exchangeable glass composition. In specific embodiments, such glass materials may be any glass material with sufficient levels of sodium ions that may be exchanged with the metal ions used to form metal layer 36. In specific embodiments, the glass material of glass body 20 is an alkali aluminosilicate glass composition or an alkali aluminoborosilicate glass composition.

Figure 6:
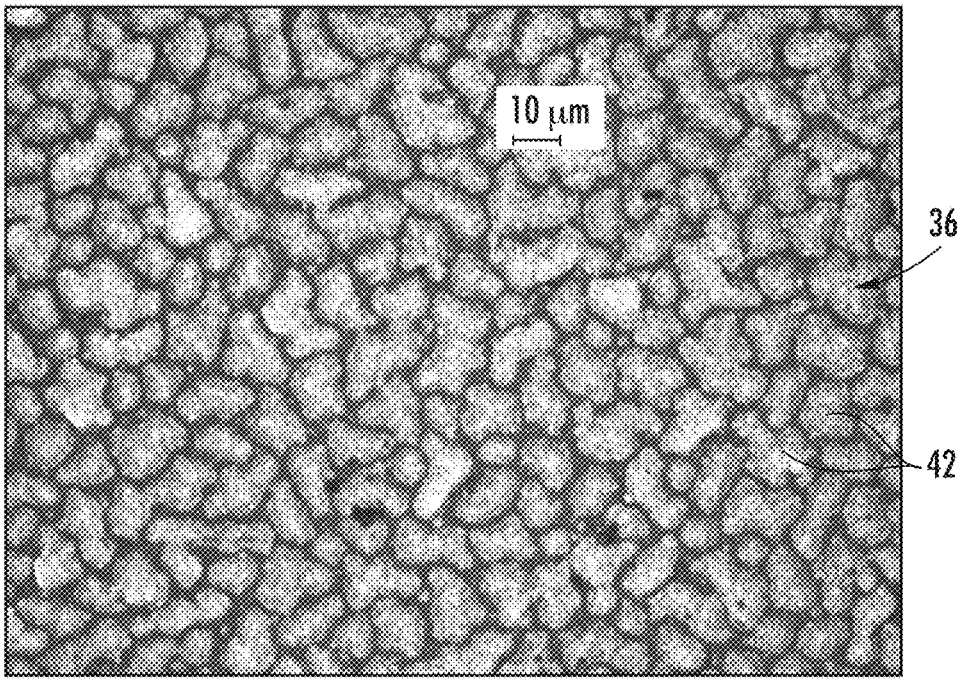
FIG. 6 is an SEM image of a surface of an embedded metallic layer of a hollow glass waveguide, according to an exemplary embodiment, where 10 μm refers to scale.

Referring to FIG. 6 a SEM image of a surface of a metallic silver, metal layer 36 formed via a silver ion exchange and reduction process is shown according to an exemplary embodiment. As can be seen in FIG. 6, unlike a surface of a metal article made through typical metal forming processes (e.g., casting, drawing, stamping, etc.), silver metal layer 36 has a random pattern of small silver particles or grains 42. However, the Inventor has found that, metal layer 36 has a low level of resistivity (i.e., within an order of magnitude of pure Ag) to provide low loss waveguide functionality to hollow glass body 20.

In specific embodiments, the resistivity of metal layer 36 is between $10^{-3}$ and $10^{-5}$ ohm per cm, which the Inventor has found provides a waveguide with low enough loss that waveguide 12 is suitable for many waveguide applications, and specifically many microwave waveguide applications. In some embodiments, waveguide 12 is specifically configured for microwave conduction and has a level of signal loss along the length of glass body 20 that is greater than 0.2 dB per centimeter of length of glass body 20, and more specifically is between 0.5 dB and 1.5 dB per centimeter of length of glass body 20. For most applications this level of loss is acceptable, and in such embodiments, waveguide 12 provides the benefits/functionality of a glass based waveguide as discussed herein.

As noted above, in specific embodiments, waveguide 12 is configured to conduct electromagnetic signals in the microwave portion of the electromagnetic spectrum. In some such embodiments, hollow channel 32 is dimensioned to conduct microwaves having frequencies from 20 GHz-50 GHz. In a specific embodiment, as shown in FIG. 4, hollow channel 32 is generally rectangular in shape and has a width dimension, W, and a height, H. In even more specific embodiments, W is between 4 mm and 13 mm, and H is between 2 mm and 7 mm to provide microwave conduction.

Figure 7:
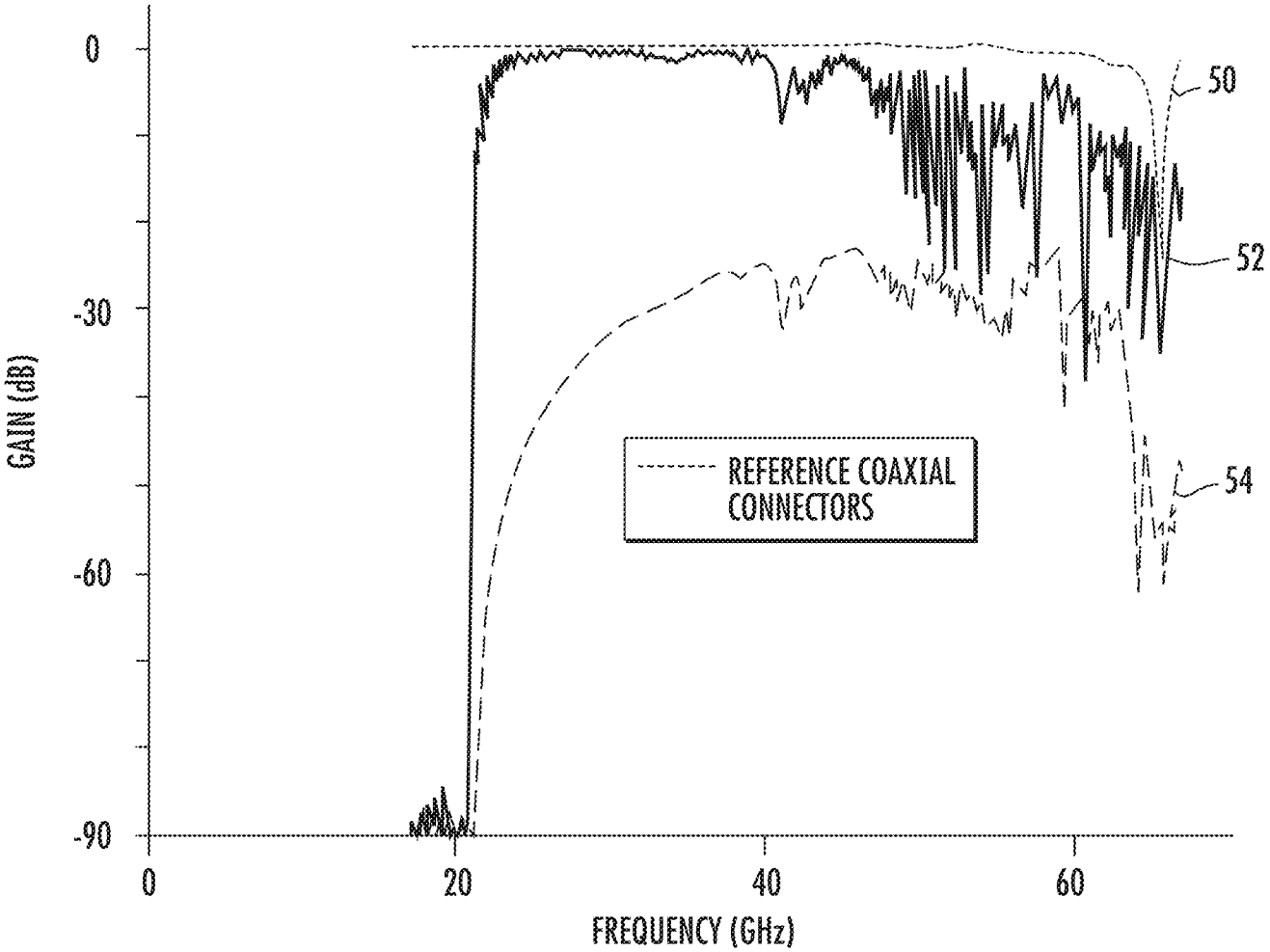
FIG. 7 is a plot of the measured transmission characteristics frequency (GHz) versus gain (dB) of a hollow glass microwave waveguide, according to an exemplary embodiment.

As discussed in detail in the Test Example section below, the Inventor has constructed and tested a glass waveguide utilizing an embedded metallic silver layer such as that shown in FIGS. 5 and 6. Transmission characteristics of such a waveguide are shown in FIG. 7. As shown in FIG. 7, plot 50 is a reference plot of transmission characteristics of reference coaxial connectors. Plot 52 shows the transmission characteristics of a traditional 30 cm length of all metal hollow waveguide with coaxial connectors at each end. Plot 54 shows the transmission characteristics of a 30 cm length of hollow glass waveguide 12 with an embedded, metallic silver layer 36 (formed via the ion-exchange process discussed herein) with coaxial connectors at each end of the waveguide. As can be seen, despite utilizing much less metal and having a somewhat higher resistivity than a traditional, hollow all metal waveguide, transmission of microwaves between at least 20 GHz and 50 GHz is at a satisfactory level for many applications.

Despite having higher losses than all metal waveguides, Applicant the Inventor believes that a glass waveguide discussed herein provides a number of benefits that are not provided by either all metal hollow waveguides or solid dielectric waveguides. In particular, processes for shaping glass into hollow structures are easier and less expensive than processes for forming similar hollow shapes from metal. In addition, because of the relative ease with which glass structures can be shaped, waveguide 12 can easily be formed into a wide variety of shapes as needed for various connections, to fit within tightly packed electronic housings, etc. In particular, the glass waveguides discussed herein may be formed into curved shapes, shapes with multiple curves, shapes with a right angle bend, shapes with multiple right angle bends, etc., that may be impossible, difficult or cost prohibitive to form from all metal hollow waveguides. While providing these benefits, the Inventor has found that the hollow glass waveguide discussed herein provides lower loss characteristics than typical solid dielectric waveguides.

Referring back to FIGS. 2-4, in addition to providing the hollow glass waveguide 12, the disclosure herein also relates to connectors designed to allow coupling between a glass hollow waveguide, such as waveguide 12, and associated electronic devices. As noted above, connectors 26 (shown in FIGS. 2 and 3) are located at each end of waveguide 12 forming a waveguide system as shown in FIG. 2. In general, as shown in FIG. 4, connector 26 includes an outer peripheral surface 60 defining an outer surface of connector 26 and an inner surface 62 that defines a central bore 64 (also as shown in FIG. 3) of connector 26.

To couple connector 26 to an end of waveguide 12, one of the ends of waveguide 12 is received into central bore 64 such that inner surface 62 surrounds the end of waveguide 12. In specific embodiments, inner surface 62 contacts a portion of outer surface 30 of waveguide 12 located at the end receiving the connector. In specific embodiments, the inner dimensions of bore 64 are sized relative to the outer dimensions of waveguide 12 to provide this contact. In specific embodiments, the dimension of inner surface 62 and of outer surface 30 are designed to be a close fit, and in a specific embodiment, the inner surface 62 is precisely cut by an air jet and then epoxied in place.

The Inventor has found that conventional connecting structures, typically made from metal, do not perform well with a glass-based hollow waveguide, such as waveguide 12. To address various coupling issues, in specific embodiments, connectors 26 are formed from a glass material. In specific embodiments, connectors 26 are formed in a single, integral unitary glass body. In such embodiments, both outer surface 60 and inner surface 62 are glass surfaces, and the glass material of connector 26 is continuous with both outer surface 60 and inner surface 62.

In specific embodiments, the glass material of connector 26 has a coefficient of thermal expansion (CTE) that is similar to the CTE of the glass material waveguide 12. In specific embodiments, the CTE of the glass material of connector 26 is within plus or minus 30%, specifically plus or minus 10%, of the CTE of the glass material of waveguide 12. The Inventor has found that improved connection between waveguide 12 and adjacent devices may be accomplished through CTE matching of the connector glass material and waveguide glass material. In some such embodiments, the glass material of connector 26 is the same glass material as the glass material of waveguide 12, and in other embodiments, the glass material of connector 26 is a different glass material from the glass material of waveguide 12.

In various embodiments, connector 26 includes one or more structures for coupling waveguide 12 to an electronic device. In the specific embodiment shown in FIG. 4, the coupling structure of connector 26 includes one or more peripheral bores 66. Peripheral bore 66 is located between inner surface 62 and outer surface 60. Peripheral bore 66 sized to receive a fastener that couples connector 26 to an electronic device. As shown in FIG. 4, in a specific embodiment, connector 26 includes four peripheral bores 66, one generally located at each corner of connector 26.

Figure 8:
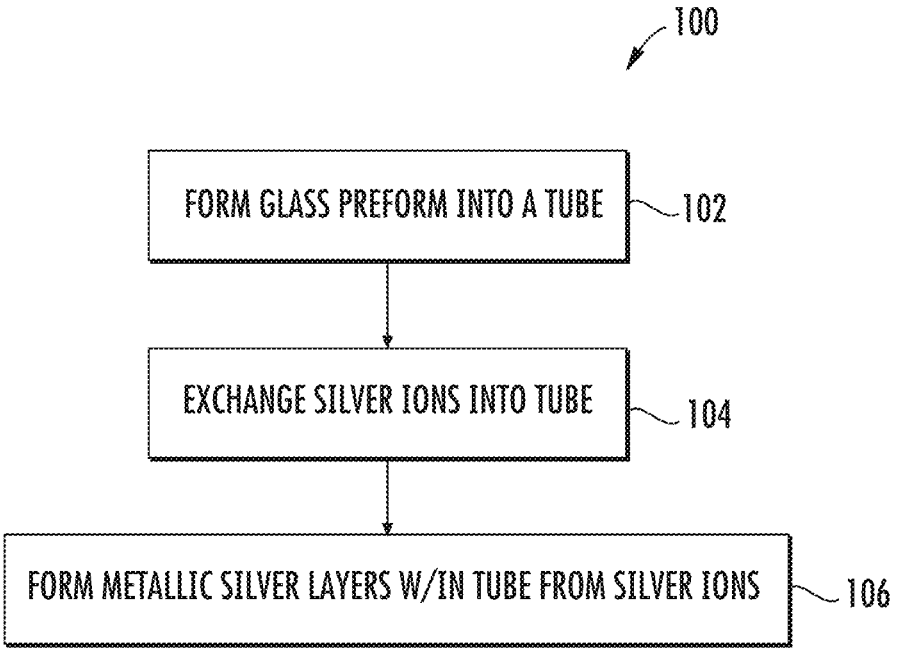
FIG. 8 shows a process for forming a hollow glass microwave waveguide, according to an exemplary embodiment.

Referring to FIG. 8, a method 100 for forming a waveguide, such as waveguide 12, is shown according to an exemplary embodiment. At step 102, a glass preform formed from an ion-exchangeable glass material is formed into a tube, such as glass waveguide body 20, described above. At step 102, the preform is shaped into the tube to provide the tube with the properly shaped channel for the desired waveguide function. In a specific embodiment, step 102 includes shaping the tube to have a channel with a first cross-sectional shape (e.g., a circular cross-sectional shape), and then subsequently reshaping the channel to have a second cross-sectional shape (e.g., a rectangular cross-sectional shape) that is different from the first cross-sectional shape. In a specific embodiment, the second cross-sectional shape is generally rectangular, with the dimensions of channel 36 as discussed above.

In a specific embodiment, a glass preform is down drawn into round tubing using a liner and bell process similar to a Vello type tube draw. This tubing may then be annealed and flame worked onto a handle tube which is also down drawn. A mandrel, such as a graphite mandrel, is shaped to have an outer dimension and shape to match the desired final rectangular shape of the hollow central channel of the tube. The round tube is placed around the mandrel, and the round tube and mandrel are placed in a furnace. The furnace is heated to the softening temperature of the glass tube causing the round tube to flow, taking on the rectangular shape of the mandrel.

At step 104, sodium ions in the ion-exchangeable glass of the tube are exchanged for silver ions through an inner surface of the tube, such as inner surface 28 of glass body 20. In a particular embodiment, the glass tube having the hollow channel of the desired waveguide geometry is placed into a bath containing the silver ions. In contrast to processes for silver ion exchange of a sheet of glass, the silver ion containing bath is exposed to the inner surface of the tube (e.g., inner surface 28) and is permitted to flow through the tube central channel providing for silver ion exchange through the inner surface of the tube.

At step 106, the silver ions in the ion-exchangeable glass of the tube are formed into at least one layer of metallic silver, such as metal layer 36 discussed above. In such embodiments, the at least one layer of metallic silver is located within the ion-exchangeable glass of the tube and is embedded a distance below the inner surface of the tube as shown in FIG. 5. In a specific embodiment, at step 106, the tube including the exchanged silver ions is positioned in flowing hydrogen gas, and the tube is heated in the flowing hydrogen gas to a reducing temperature of about 300° C. or less for a treatment period Q to form the plurality of discrete layers of metallic silver in the tube. In specific embodiments, 5 minutes $\leq Q \leq 50$ hours. Additional details and specific embodiments related to silver ion exchange and formation of embedded metallic layer(s) from the exchanged silver ions can be found in U.S. Pat. No. 9,586,861, issued Mar. 7, 2017, which is incorporated herein by reference in its entirety.

TEST EXAMPLE

A glass preform formed from Corning Gorilla Glass was down drawn into round tubing using a liner and bell process similar to a Vello type tube draw. The tubing was down drawn out of the liner with geometry of 8.55 mm OD outer diameter (i.e. OD)×5.75 mm inner diameter (i.e. ID) and 1.4 mm wall thickness. The ID of the round tubing was selected based on the final desired rectangle ID (rectangular width+rectangular height)/2. The round tubing was annealed and then flame worked onto a handle tube which was also down drawn. A graphite mandrel was machined to have an outer surface with the rectangular dimensions matching the desired rectangular dimensions of the channel of the hollow tube. As will be understood, in this type of shaping process, the outer surface mandrel shape dictates the final shape of the hollow channel of the final glass tube.

To reshape the round tube, the mandrel is suspended inside the tube within the flame worked section between the handle and the smaller round tube portion which is being reshaped. This was accomplished using a molybdenum ("moly") rod and using a moly wire loop going through a hole in the end of the mandrel. The opposite end of moly rod (i.e., the end not connected to the mandrel) is attached to a chuck suspended over the furnace on the draw tower.

The bottom of the glass handle has a flared end formed by flame working and a wire loop is attached around this end. The wire loop is used to hang weight onto the whole assembly. Once the assembly of mandrel, tube, handle, moly rod and weight are all suspended and positioned in the furnace, the furnace temperature is raised to around the softening point of the glass material of the tube. As the glass approaches a viscosity of around $10^8$ P to $10^9$ P, the glass will start to flow around the mandrel taking on the rectangular shape at the shoulder of the mandrel.

During the reshaping process, the mandrel is positioned horizontally in the furnace which is believed to impact the final shape and wall thickness of the final formed tube. Within the furnace, the tube is moved over the mandrel at a steady pace. Typical reshaping speeds are on the order of 50 to 75 mm/min. depending on wall thickness, glass composition and size of tube being formed. The reshaping of the glass tube via this process resulted in a rectangular tube having a 8.6 mm OD×4.4 mm ID with a 0.8 mm wall thickness.

Next, the hollow tube is exposed to a $AgNO_3$ bath (see Table 1 below) to exchange $Ag^+$ for the alkali ion of the glass material. Table 1 below provides silver ion-exchange conditions used to form the glass waveguide (where "IX" in Table 1 refers to ion-exchange).

TABLE 1

| | |
|---|---|
| Concentration | 1% AgNO3/99% KNO3-20% AgNO3/80% KNO3 |
| IX temp ° C. | 350° C.-450° C. |
| IX duration Hrs | 30 minutes-8 hours |
| $H_2$ reduction temp | 100% H2 350° C.-450° C. |
| $H_2$ reduction time | 30 minutes-24 hours |

Next, the silver ion exchanged glass tube is exposed to a $H_2$ atmosphere according to the schedule shown in the Table 1. This causes a reduction of the Ag ions into metallic silver layers as shown in FIGS. 5 and 6 discussed above. Performance of the waveguide formed from this process is shown in FIG. 7.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more components or elements, and is not intended to be construed as meaning only one.

It will be apparent to those skilled in the art that various modifications and variations can be made without departing from the spirit or scope of the disclosed embodiments. Since modifications, combinations, sub-combinations and variations of the disclosed embodiments incorporating the spirit and substance of the embodiments may occur to persons skilled in the art, the disclosed embodiments should be construed to include everything within the scope of the appended claims and their equivalents.

What is claimed is:

1. A microwave waveguide comprising:

a glass body comprising:

a first end;

a second end;

an outer glass surface extending between the first end and the second end;

an inner glass surface defining a hollow channel that extends from the first end to the second end; and a glass material disposed between the outer surface and the inner surface; and a layer of metal embedded in the glass body, the layer of metal surrounding the hollow channel and extending between the first end and the second end of the glass body;

wherein the layer of metal is electrically conductive and the hollow channel is dimensioned such that microwaves introduced into the hollow channel are conducted along the hollow channel between the first end and the second end.

2. The microwave waveguide of claim 1, wherein the glass body is continuous with the outer glass surface and the inner glass surface such that the glass body is a single, integral, unitary glass body in which the layer of metal is embedded within, wherein the hollow channel is dimensioned to conduct microwaves having frequencies from 20 GHz to 50 GHz.

3. The microwave waveguide of claim 1, wherein the inner glass surface has a rectangular cross-sectional shape, having a height dimension and a width dimension.

4. The microwave waveguide of claim 3, wherein the width dimension is between 4 mm and 13 mm, and the height dimension is between 2 mm and 7 mm.

5. The microwave waveguide of claim 1, wherein the glass body has a length between the first end and the second end, wherein a microwave signal loss along the length of the glass body is greater than 0.2 dB per centimeter of length of the glass body.

6. The microwave waveguide of claim 5, wherein the microwave signal loss along the length of the glass body is between 0.5 dB and 1.5 dB per centimeter of length of the glass body.

7. The microwave waveguide of claim 1, wherein a resistivity of the layer of metal is between $10^{-3}$ and $10^{-5}$ ohm per cm.

8. The microwave waveguide of claim 1, wherein the layer of metal is embedded adjacent the inner glass surface by a distance of less than or equal to 5 μm.

9. The microwave waveguide of claim 1, wherein the layer of metal comprises metallic silver, and wherein the layer of metal comprises a plurality of discreet layers of the metallic silver located at different depths within the glass body.

10. The microwave waveguide of claim 1, wherein the glass material of the glass body is an ion-exchangeable glass composition.

11. The microwave waveguide of claim 10, wherein the glass material of the glass body is an alkali aluminosilicate glass composition or an alkali aluminoborosilicate glass composition.

12. A waveguide system comprising:

a glass waveguide comprising:

a first end;

a second end;

an outer peripheral surface;

an inner surface defining a hollow channel that extends from the first end to the second end; and a first glass material located between the outer peripheral surface and the inner surface;

a layer of metal embedded in the first glass material, the layer of metal surrounding the hollow channel; and a glass connector coupled to the first end of the glass waveguide, the connector comprising:

an outer peripheral surface;

an inner surface defining a central bore, wherein the first end of the glass waveguide is received into the central bore such that the glass connector surrounds the first end of the glass waveguide; and a second glass material located between the outer peripheral surface and the inner surface of the glass connector.

13. The waveguide system of claim 12, wherein a coefficient of thermal expansion of the second glass material is within plus or minus 30% of a coefficient of thermal expansion of the first glass material.

14. The waveguide system of claim 12, wherein the first glass material is continuous with the outer peripheral surface of the glass waveguide and with the inner surface of the glass waveguide, wherein the second glass material is continuous with the outer peripheral surface of the glass connector and with the inner surface of the glass connector such that the glass connector is formed from a single, unitary glass body, and wherein the inner surface of the glass connector contacts the outer peripheral surface of the glass waveguide.

15. The waveguide system of claim 12, wherein the connector further comprises a peripheral bore located between the outer peripheral surface of the connector and the central bore, the peripheral bore sized to receive a fastener that couples the glass connector to an electronic device.

16. The waveguide system of claim 12, wherein the layer of metal is embedded adjacent the inner surface of the glass waveguide by a distance of less than or equal to 5 μm.

17. The waveguide system of claim 16, wherein the layer of metal comprises metallic silver, and wherein the layer of metal comprises a plurality of discreet layers of metallic silver located at different depths within the first glass material of the waveguide.

18. The waveguide system of claim 12, wherein the glass first material of the glass waveguide is an ion-exchangeable glass composition.

19. A microwave waveguide comprising:

a glass body comprising:

a first end;

a second end;

an outer glass surface extending between the first end and the second end;

an inner glass surface defining a hollow channel that extends from the first end to the second end; and a glass material disposed between the outer surface and the inner surface; and a layer of metal embedded in the glass body, the layer of metal surrounding the hollow channel and extending between the first end and the second end of the glass body;

wherein the layer of metal is electrically conductive and the hollow channel is dimensioned such that microwaves introduced into the hollow channel are conducted along the hollow channel between the first end and the second end, and wherein the hollow channel is dimensioned to conduct microwaves having frequencies from 20 GHz to 50 GHz.

20. The microwave waveguide of claim 19, wherein the glass body has a length between the first end and the second end, and wherein a microwave signal loss along the length of the glass body is between 0.5 dB and 1.5 dB per centimeter of length of the glass body.

* * * * *